US008240469B2

(12) United States Patent
Goda

(10) Patent No.: US 8,240,469 B2
(45) Date of Patent: Aug. 14, 2012

(54) PACKAGING CONTAINER

(75) Inventor: Hideyuki Goda, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 41 days.

(21) Appl. No.: 12/805,985

(22) Filed: Aug. 27, 2010

(65) Prior Publication Data

US 2011/0048990 A1 Mar. 3, 2011

(30) Foreign Application Priority Data

Aug. 28, 2009 (JP) ..... 2009-198199
Apr. 28, 2010 (JP) ..... 2010-104139

(51) Int. Cl.
*B65D 19/00* (2006.01)

(52) U.S. Cl. ..... 206/386; 206/597; 206/600

(58) Field of Classification Search ..... 206/523, 206/586, 386, 600, 395, 598, 596, 597; 108/55.1, 108/55.5, 55.3; 229/937
See application file for complete search history.

(56) References Cited

U.S. PATENT DOCUMENTS 3,701,465 A * 10/1972 Richter ..... 206/521
4,445,614 A * 5/1984 Mitsumori et al. ..... 206/599
4,927,026 A * 5/1990 Gossler et al. ..... 206/600
5,692,618 A * 12/1997 Beak ..... 206/586
2009/0242456 A1* 10/2009 Goda ..... 206/598
2010/0213088 A1* 8/2010 Goda ..... 206/386

FOREIGN PATENT DOCUMENTS

JP 58-125187 8/1983
JP 06-115550 A 4/1994
JP 07-069372 A 3/1995
JP 2004-182279 A 7/2004

* cited by examiner

*Primary Examiner* — David Fidei
(74) *Attorney, Agent, or Firm* — Harness, Dickey & Pierce, P.L.C.

(57) ABSTRACT

A container includes a pallet, an enclosure base, an enclosure box, and a set of fasteners. The pallet is disposed at a bottom of the container. The enclosure base is placed on the pallet, and includes a lower base sheet and an upper base sheet. The lower base sheet forms a first pair of side flaps. The upper base sheet forms a second pair of side flaps. The enclosure box is placed on the enclosure base, and includes a top wall, a set of four side walls, and an open bottom. The four side walls of the enclosure box rest on the lower base sheet while surrounding the upper base sheet to position the first pair of opposed side flaps outside the enclosure box, and the second pair of opposed side flaps inside the enclosure box. The set of fasteners fastens the enclosure base to the enclosure box.

20 Claims, 13 Drawing Sheets

PACKAGING CONTAINER

CROSS-REFERENCE TO RELATED APPLICATIONS

The present patent application claims priority pursuant to 35 U.S.C. §119 from Japanese Patent Application Nos. 2009-198199 and 2010-104139, filed on Aug. 28, 2009, and Apr. 28, 2010, respectively, which are hereby incorporated by reference herein in their entirety.

BACKGROUND OF THE INVENTION

1. Field of the Invention

The present invention relates to a packaging container, and more particularly, to a packaging container using a pallet and enclosure box to package an article for storage and transport.

2. Discussion of the Background

Shipping containers are used to package large electronic equipment such as printers and photocopiers for storage and transport. A typical design of such containers includes an upper enclosure box to enclose an article therewithin, and a lower mounting platform or pallet having an open-sided hollow structure to accommodate tines of a forklift during handling of the container. The enclosure box is made of corrugated cardboard with the pallet formed of wood or plywood for strength and durability, although cardboard pallets are often used depending on specific applications.

FIG. 1 is an exploded perspective view schematically illustrating a conventional packaging container 1.

As shown in FIG. 1, the packaging container 1 includes a pallet 10 placed at the bottom; an enclosure base 11 bonded to the upper side of the pallet 10; an enclosure box 15 to enclose an article such as a printer, not shown, placed on the enclosure base 11; and a set of fasteners 17 for fastening the enclosure box 15 to the enclosure base 11.

In the packaging container 1, the pallet 10 comprises an open-sided hollow structure made of corrugated cardboard substantially rectangular in plan to support the entire enclosure thereon.

The enclosure base 11 comprises a folded sheet of corrugated cardboard, consisting of a substantially rectangular, center panel 12C; a first pair of opposed side flaps 12A each bored with two through-holes 14 for fastening with the fasteners 17, extending substantially vertically upward from a first pair of opposed, parallel edges 12*a* of the center panel 12C; and a second pair of opposed side flaps 12B for positioning the article being enclosed, extending substantially vertically upward from a second pair of opposed, parallel edges 12*b* of the center panel 12C.

The enclosure box 15 comprises an open-bottom box with a bottom side defining an opening to pass the article therethrough during placement onto the enclosure base 11, consisting of a top wall to cover the article from above, and four side walls to surround the article from all sides, two of which, on opposite sides, are bored with through-holes 16 to align with the through-holes 14 of the side flaps 12A when installed.

To assemble the packaging container 1, the pallet 10 is initially provided with the enclosure base 11 in a blank, unfolded state, attached to the upper surface of the pallet 10 with suitable adhesive. The enclosure base 11 is folded along the first pair of side edges 12*a* to raise the fastening flaps 12A substantially vertically upward, and along the second pair of side edges 12*b* to raise the positioning flaps 12B substantially vertically upward. After the enclosure base 11 is thus prepared, an article is mounted on the enclosure base 11 and provided with appropriate cushioning, such as expanded polystyrene foam pieces, followed by placing the enclosure box 15 from above onto the pallet 10 so that the article may pass through the bottom opening of the enclosure box 15 being installed. Assembly is completed by inserting the fasteners 17 into the through-holes 16 and 14 being aligned to each other, which fasten the enclosure box 15 to the enclosure base 16 by holding together their adjoining side walls.

In the packaging container 1 thus assembled, the entire dimensions of the enclosure base 11, including the center panel 12C as well as the side flaps 12A and 12B extending upward, are located within the enclosure box 15. This means the four side walls of the enclosure box 15 all rest on the upper surface of the pallet 10 and not on the center panel 12C of the enclosure base 11. To prevent the enclosure box 15 from accidentally slipping off the pallet 10, clearance C is provided between the adjoining edges of the enclosure box 15 and the pallet 10, which securely maintains the enclosure box 15 in position on the rectangular pallet 10 even when the container 1 is elevated, inclined, or impacted during transport and storage. Such provision of clearance, however, is an inefficient use of the limited area over the pallet 10, which would otherwise be used as part of the enclosure.

For optimizing space usage of the palletized container, a modified design has been proposed, in which the fastening flaps of the enclosure base are located outside the enclosure box, allowing for reduced clearance between the adjoining edges of the enclosure box and the pallet. FIGS. 2A and 2B are plan and partial side views, respectively, schematically illustrating such a modified packaging container 2.

As shown in FIGS. 2A and 2B, the general configuration of the packaging container 2 is similar to that depicted with reference to FIG. 1, including a cardboard pallet 20 placed at the bottom; a cardboard enclosure base 21 bonded to the upper side of the pallet 20; an enclosure box 25 to enclose an article such as a printer, not shown, placed on the enclosure base 21; and a set of fasteners, not shown, for fastening the enclosure box 25 to the enclosure base 21.

With additional reference to FIG. 3, which is a plan view schematically illustrating the enclosure base 21 in its blank, unfolded state, the enclosure base 21 used in the modified container 2 consists of a substantially rectangular, flat center panel 22C for attachment to the upper surface of the pallet 20; a pair of fastening flaps 22A provided with through-holes 24, extending from a first pair of opposed parallel side edges 22*a* of the center panel 22C; and a pair of positioning flaps 22B extending from a second pair of opposed parallel side edges 22*b* of the center panel 22C, all of which are integrally cut out of a single sheet of corrugated cardboard.

Assembly of the packaging container 2 is carried out in a manner similar to that depicted above, wherein the pallet 20 is initially provided with the enclosure base 21 folded along the first pair of side edges 22*a* to raise the fastening flaps 22A substantially vertically upward, and along the second pair of side edges 22*b* to raise the positioning flaps 22B substantially vertically upward, followed by mounting an article on the enclosure base 21, cushioning the article, placing the enclosure box 25 from above onto the pallet 20, and finally fastening the enclosure box 25 to the enclosure base 26 with the fasteners.

FIG. 4A is a partial perspective view schematically illustrating one corner of the packaging container 2 assembled, and FIG. 4B is an enlarged side view taken in the direction indicated by arrow A of FIG. 4A.

As shown in FIGS. 4A and 4B, the enclosure base 21 is sized and positioned with respect to the enclosure box 25 so as to position the fastening flaps 22A outside the enclosure box 25 and the positioning flaps 22B inside the enclosure box 25 when the container 2 is assembled. This means that in the assembled container 2, the side walls of the enclosure box 25 facing the fastening flaps 22A rest on the center panel 22C of the enclosure base 21, whereas those facing the positioning flaps 22B are left unseated slightly above the upper surface of the pallet 20. Compared to the conventional design depicted earlier, such a configuration allows the bottom edges of the enclosure box to be located closer to the outer edges of the pallet, which maximizes the area or space available for enclosing the article in the palletized container 2.

The modified packaging container 2, however, still has several drawbacks. One drawback is that the enclosure box 20, with its bottom edge not fully seated on the underlying surface, is susceptible to damage when subjected to loads.

With specific reference to FIG. 4B, the enclosure box 25 is shown with one side wall resting on the center panel 22C of the enclosure base 21 and another, adjoining side wall spaced away from the upper surface of the pallet 20 by a distance $\Delta d$ corresponding to the thickness of the center panel 22C. When the packaging container 2 is under load, the spacing $\Delta d$ between the bottom edge of the enclosure box 25 and the surface of the pallet 20 causes a concentrated stress that deforms or crushes the bottom edge of the enclosure box 25 around the corner of the enclosure box 25. The problem is particularly pronounced where the packaging container 2 is disposed under another container or several more containers, resulting in a reduced durability of the cardboard box which does not meet requirements for packaging large equipment for shipping.

Another drawback of the packaging container 2 is a considerable loss of material occurring in the production of the enclosure base 21. That is, forming the enclosure base 21 of a non-rectangular, complex polygonal blank cut out of a sheet of corrugated cardboard leaves remains 28 of the material where the adjacent edges of the side flaps 22A and 22B form a concave corner (see FIG. 3). Such remains 28 are typically disposed of as unusable material to be wasted, resulting in reduced cost and resource efficiency during manufacture of the packaging container.

SUMMARY OF THE INVENTION

Exemplary aspects of the present invention are put forward in view of the above-described circumstances, and provide a novel packaging container used to package an article.

In one exemplary embodiment, the novel packaging container includes a pallet, an enclosure base, an enclosure box, and a set of fasteners. The pallet is disposed at a bottom of the container. The enclosure base is placed on the pallet to support the article thereon, and includes a generally rectangular, lower base sheet overlying and attached to the pallet and a generally rectangular, upper base sheet overlying and attached to the lower base sheet. The lower base sheet has a pair of opposed parallel edges unfolded and another pair of opposed parallel edges folded to form a first pair of side flaps extending substantially upward therefrom. The upper base sheet has a pair of opposed parallel edges unfolded and another pair of opposed parallel edges folded to form a second pair of side flaps extending substantially upward therefrom. The enclosure box is placed on the enclosure base to enclose the article therewithin, and includes a top wall, a set of four side walls, and an open bottom. The top wall covers the article from above. The set of four side walls extends from the top wall to surround the article from all sides. The open bottom is defined by edges of the four side walls opposite to the top wall to allow entry of the article during installation. The four side walls of the enclosure box rest on the lower base sheet while surrounding the upper base sheet to position the first pair of opposed side flaps outside the enclosure box, and the second pair of opposed side flaps inside the enclosure box. The set of fasteners each is passed from outside through one of the first pair of opposed side flaps and then through one of the side walls of the enclosure box to fasten the enclosure base to the enclosure box.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
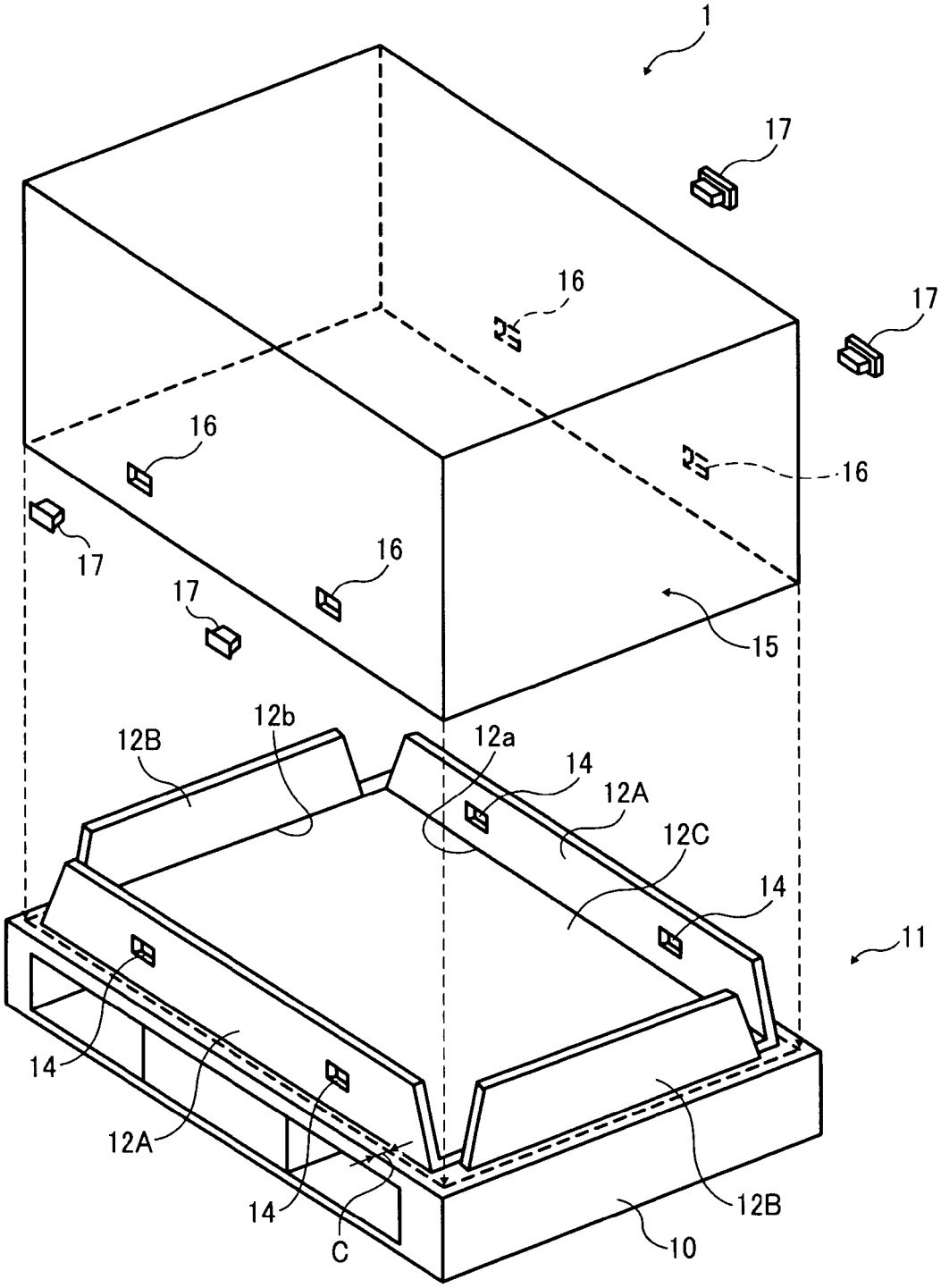
FIG. 1 BACKGROUND ART
FIG. 1 is an exploded perspective view schematically illustrating a conventional packaging container.
Figure 2A:
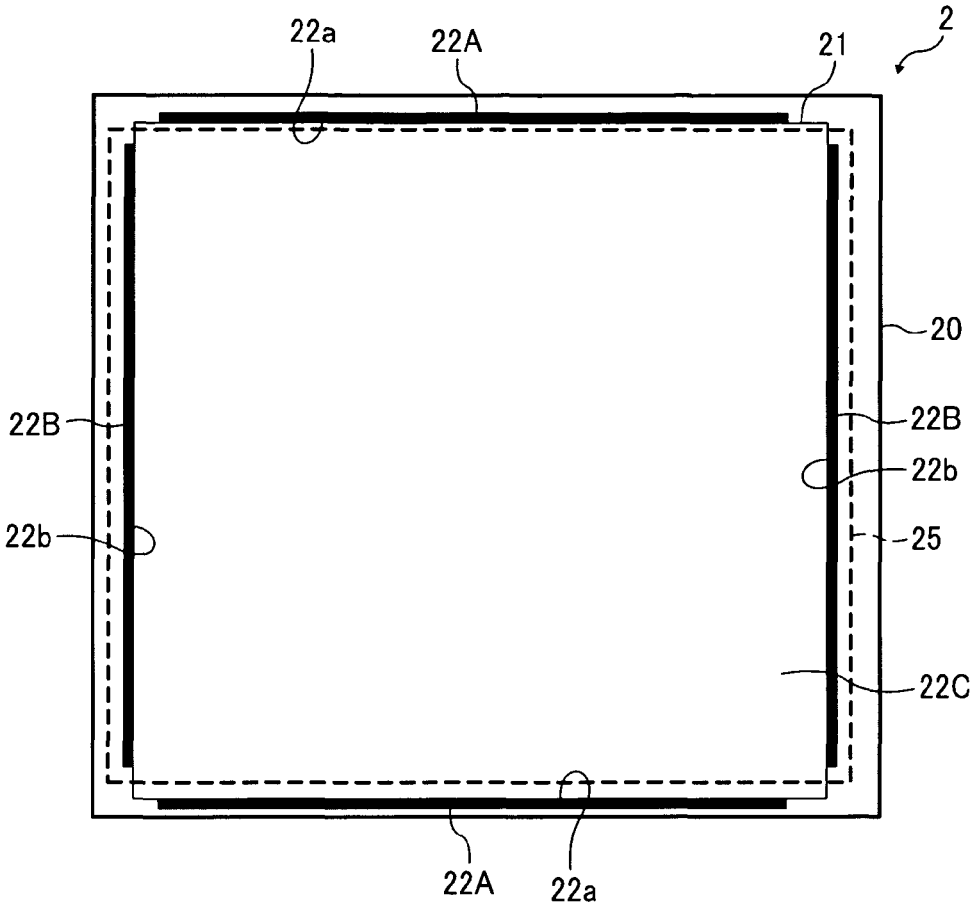
FIG. 2A BACKGROUND ART
FIGS. 2A and 2B are plan and partial side views, respectively, schematically illustrating another conventional packaging container.
Figure 2B:
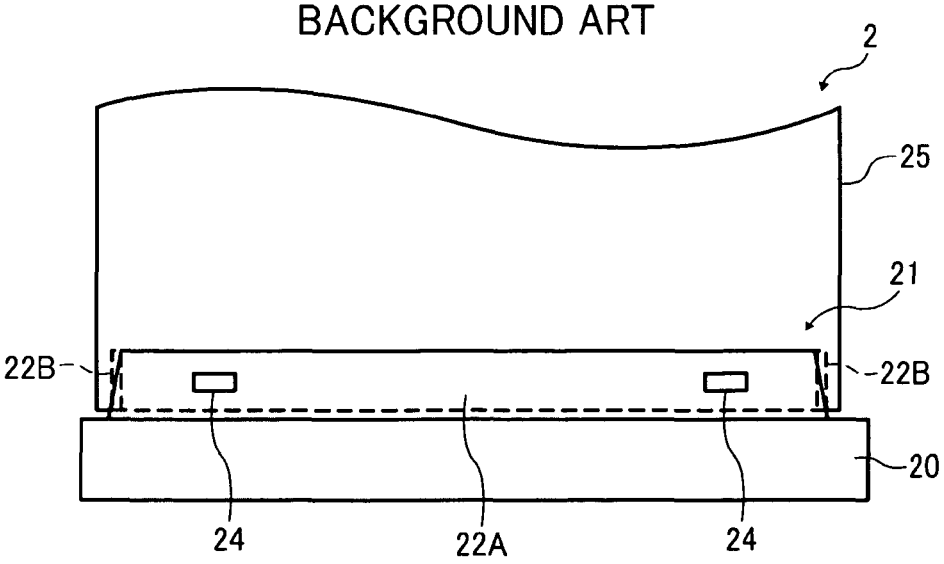
FIG. 2B BACKGROUND ART
Figure 3:
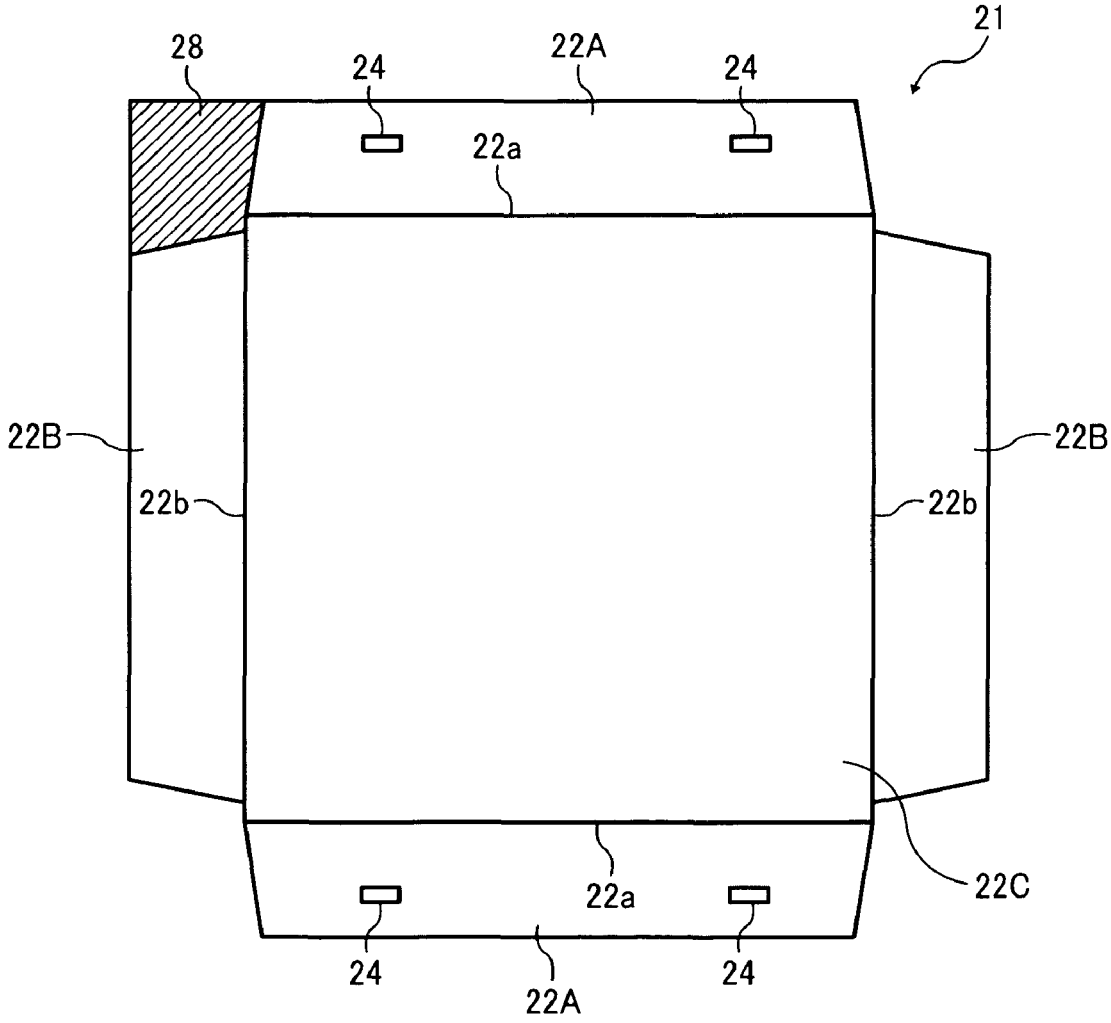
FIG. 3 BACKGROUND ART
FIG. 3 is a plan view schematically illustrating an enclosure base in a blank, unfolded state before assembly into the packaging container of FIGS. 2A and 2B.
Figure 4A:
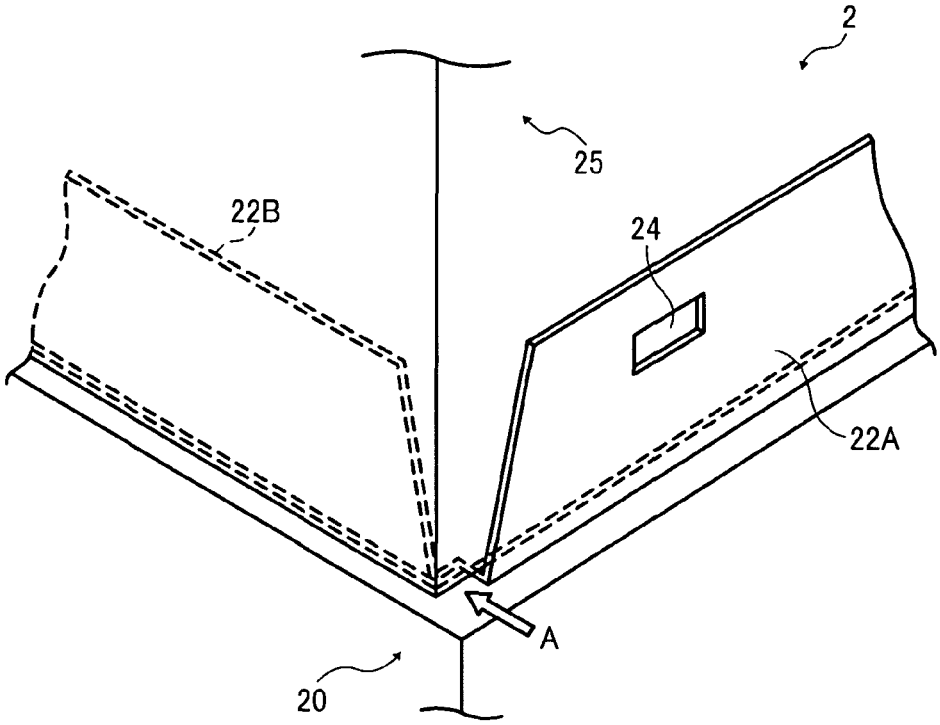
FIG. 4A BACKGROUND ART
FIG. 4A is a partial perspective view schematically illustrating one corner of the packaging container of FIGS. 2A and 2B.
Figure 4B:
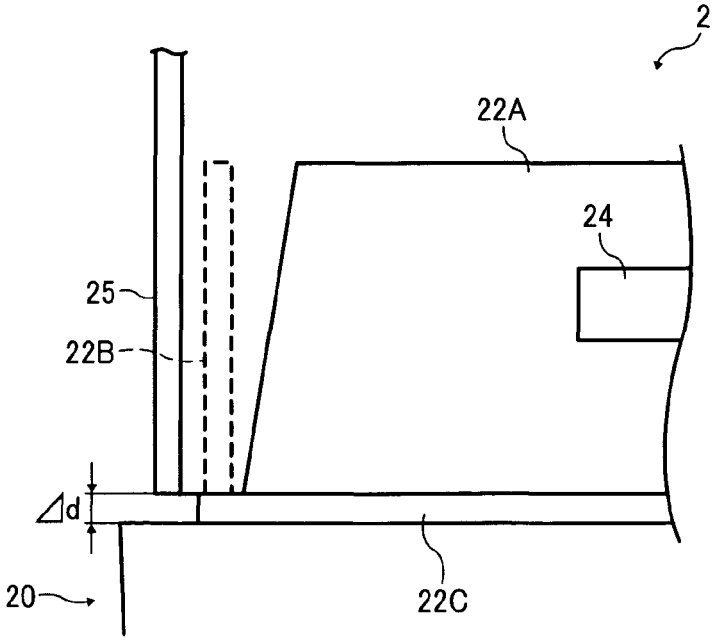
FIG. 4B BACKGROUND ART
FIG. 4B is an enlarged side view taken in the direction indicated by arrow A of FIG. 4A.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts, throughout the several views, exemplary embodiments of the present patent application are described.

Figure 5:
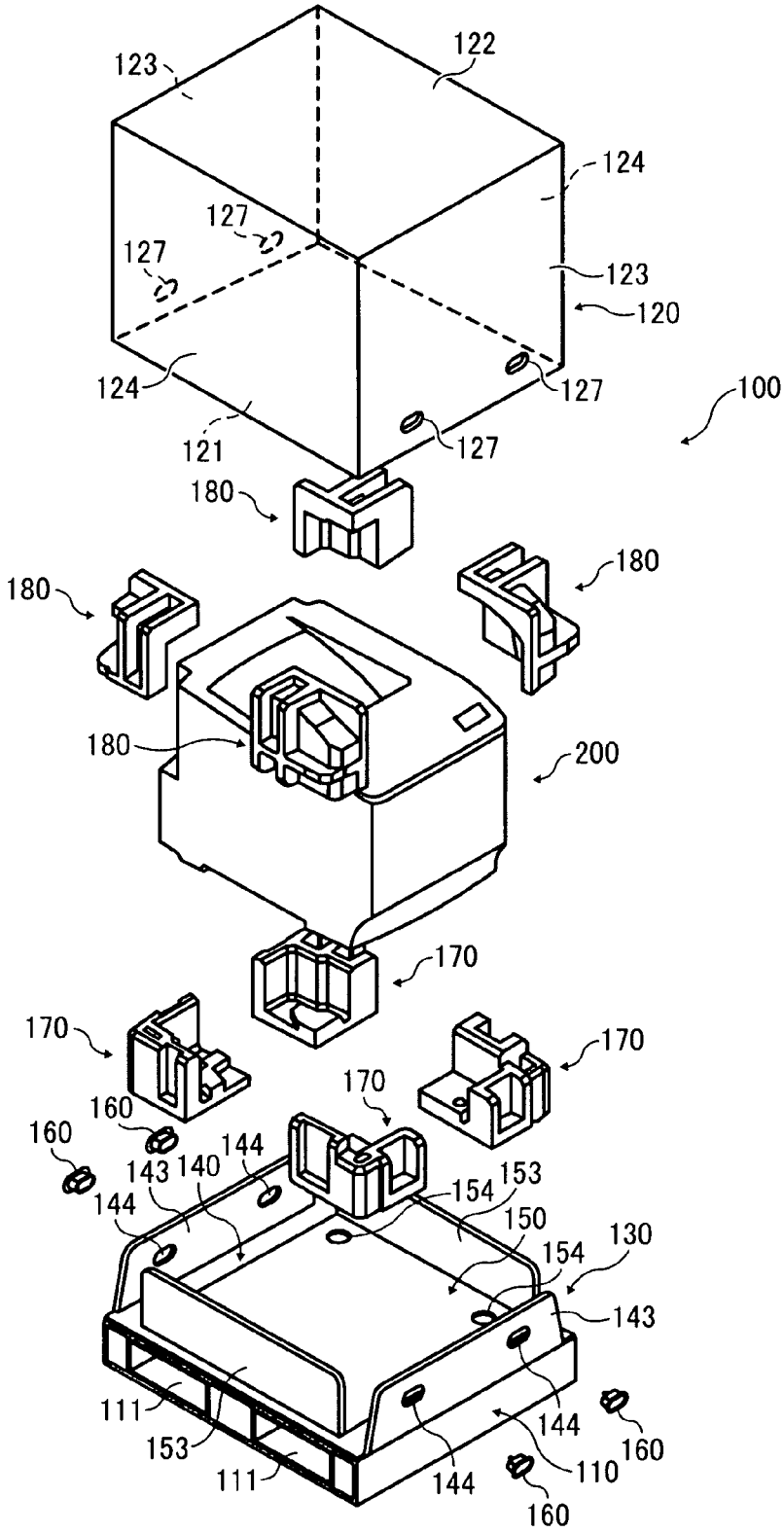
FIG. 5 is an exploded perspective view schematically illustrating a packaging container according to one embodiment of this patent specification.
Figure 6:
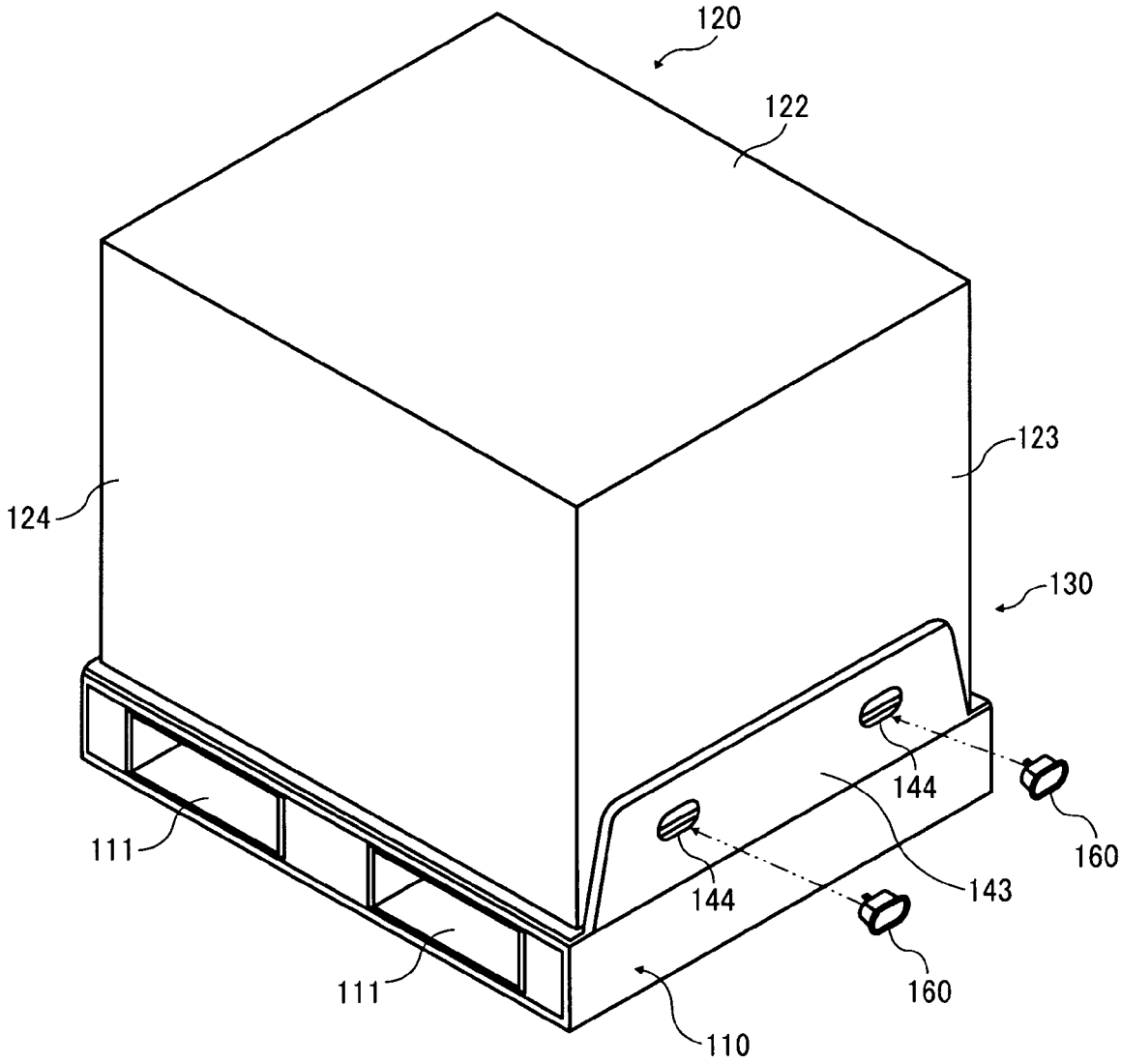
FIG. 6 is a perspective view schematically illustrating the assembled packaging container of FIG. 5.

FIGS. 5 and 6 are exploded and assembled perspective views, respectively, schematically illustrating a packaging container 100 for packaging an article 200 according to one embodiment of this patent specification.

As shown in FIGS. 5 and 6, the container 100 includes a pallet 110 lying at the bottom to carry a load on an upper surface thereof; an enclosure base 130 formed of a lower, exterior base sheet 140 and an upper, interior base sheet 150 combined together and placed on the load-carrying surface of the pallet 110 to support the article 200 thereon; an open-ended enclosure box 120 placed on the enclosure base 130 to enclose the article 200 therewithin; a set of fasteners 160 to fasten the enclosure base 130 to the enclosure box 120; four bottom corner cushions 170 to cushion bottom corners of the article 200; and four top corner cushions 180 to cushion top corners of the article 200, all of which are assembled into an integrated structure for packaging the article 200, such as a printer, for storage and transport.

Specifically, in the packaging container 100, the pallet 110 comprises an open-sided hollow structure made of corrugated cardboard, substantially rectangular in plan and sufficiently sturdy to withstand weight of the enclosed article 200 and that of several other containers stacked thereon. The pallet 110 has a first pair of opposed parallel sides closed, and a second pair of oppose parallel sides defining a set of forklift entries 111 to allow entry of forks or tines of a forklift into the hollow interior.

The enclosure box 120 comprises an open-ended, generally rectangular box formed of corrugated cardboard or plastic board, with an open bottom 121 for inserting the article 200 therethrough when placed on the pallet 110; a top wall 122 opposed to the open bottom 121 for covering from above the article 200 on the pallet 110; first and second pairs of parallel side walls 123 and 124 extending vertically from the top wall 122 to the bottom opening 121 for surrounding from all sides the article 200 on the pallet 110; and four through-holes 127, two on each side wall 123 adjacent to the open bottom 121, for inserting the fasteners 160 therethrough.

The side walls 123 and 124 of the enclosure box 120 are sized and shaped to accommodate the height and width of the article 200 enclosed, while allowing the open bottom 121 to entirely fit within the rectangular plan of the pallet 110. In particular, the side walls 123 and 124 have their bottom edges flush with each other to together form a bottom edge of the enclosure box 120 that can establish a uniform contact with a flat plane on which it is placed.

In the assembled container 100, the enclosure box 120 is placed on the lower base sheet 140 of the enclosure base 130 bonded to the pallet 110, with the bottom edge or the edges of the side walls 123 and 124 uniformly contacting the lower base sheet 140. The enclosure box 120 is directed so that each side wall 123 having the through-holes 127 therein faces the closed side of the pallet 110, where the box 120 is fastened to the enclosure base 130 with the fasteners 160 inserted into the through-holes 127.

Figure 7:
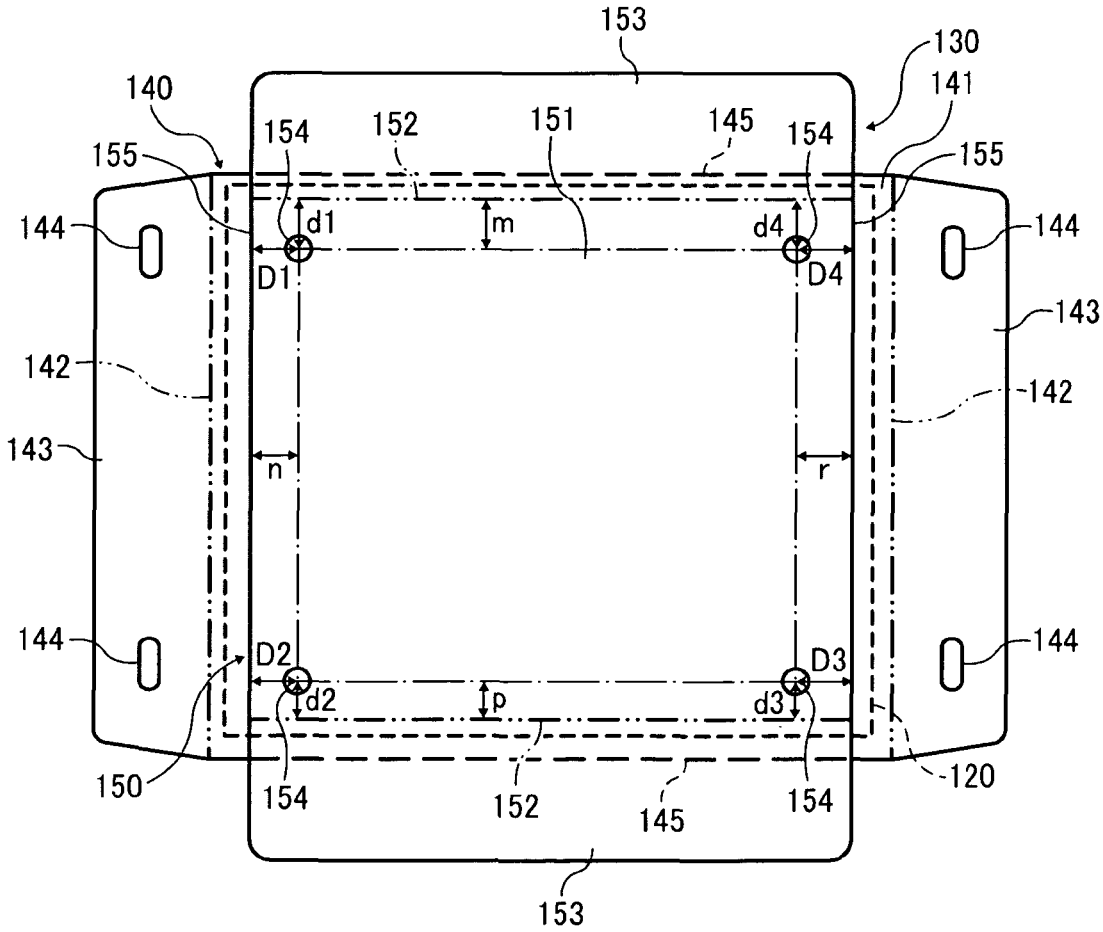
FIG. 7 is a plan view schematically illustrating an enclosure base for use in the packaging container of FIG. 5 in a blank, unfolded state before assembly.

FIG. 7 is a plan view schematically illustrating the enclosure base 130 in a blank, unfolded state before assembly into the packaging container 100.

As shown in FIG. 7, the enclosure base 130 comprises a layered structure formed of the lower base sheet 140 and the upper base sheet 150 superimposed and bonded together, the former for attachment to the pallet 110 and the latter for facing the bottom of the article 200 when assembled into the packaging container 100.

The lower base sheet 140 comprises a generally rectangular piece of corrugated cardboard, consisting of a substantially rectangular, flat center panel 141 slightly smaller in plan than the load-carrying surface of the pallet 110, with a pair of opposed parallel side edges 145 unfolded and another pair of opposed parallel side edges 142 defining a pair of parallel fold lines; and a pair of side, fastening flaps 143 extending outward from the center panel 141 and foldable along the fold lines 142, each bored with a pair of openings 144 for engagement with the fasteners 160.

The upper base sheet 150 comprises a generally rectangular piece of corrugated cardboard, consisting of a substantially rectangular, flat center panel 151 slightly smaller in plan than the center panel 141 of the lower base sheet 140, with a pair of opposed parallel side edges 155 unfolded and another pair of opposed parallel side edges 152 defining a pair of parallel fold lines; a pair of side, positioning flaps 153 extending outward from the center panel 151 and foldable along the fold lines 152 for positioning the article 200 within the enclosure box 120; and a set of four positioning slots 154 of circular or any suitable shape, each adjacent to a corner formed by the unfolded and folded edges 155 and 152 of the center panel 151 for positioning the bottom corner cushions 170 on the enclosure base 130.

Figure 8:
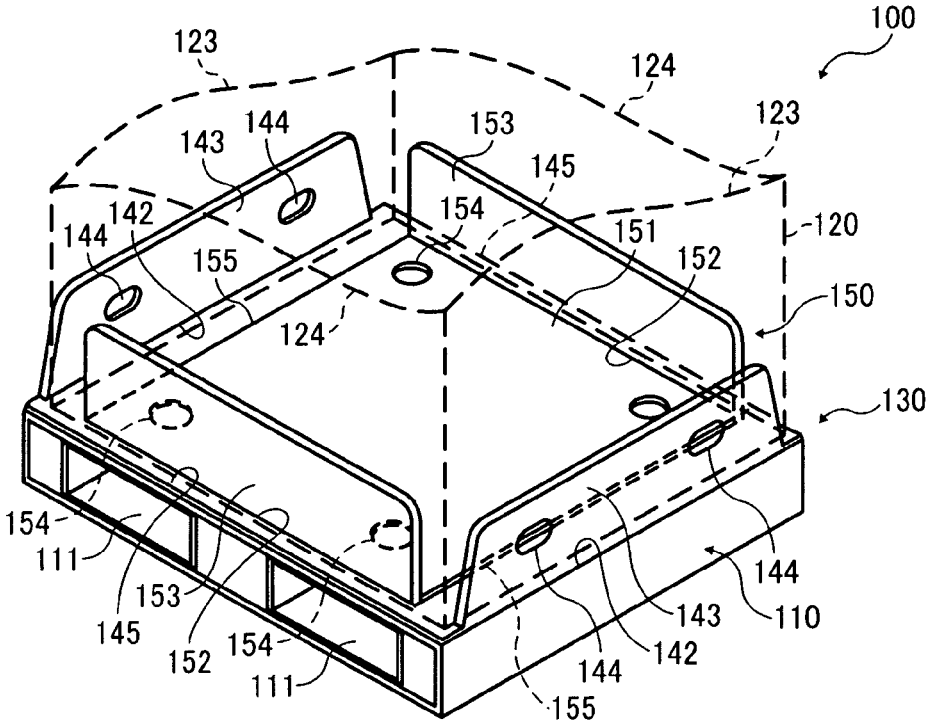
FIG. 8 is a perspective view schematically illustrating the enclosure base of FIG. 7 upon installation.

With additional reference to FIG. 8, which is a perspective view schematically illustrating the enclosure base 130 installed on the pallet 110, the enclosure base 130 is placed on the pallet 110 with the fastening flaps 144 located on the closed sides of the pallet 110 and the positioning flaps 153 on the open sides of the pallet 110. The lower base sheet 140 has the side flaps 143 folded upward along the fold lines 142, and the center panel 141 attached with an adhesive to the load-carrying surface of the pallet 110. The upper base sheet 150 has the side flaps 153 folded upward along the fold lines 152, and the center panel 151 attached with an adhesive to the center panel 141 of the lower base sheet 140.

The openings 144 defined in the fastening flaps 143 are aligned with the through-holes 127 of the enclosure box 120 for allowing insertion of the fasteners 160 therethrough. The positioning flaps 153 serve to hold the article 200 in position while preventing damage to the enclosure box 120 by transmitting load to the underlying pallet 110 during transport where the container 100 is tilted or impacted.

The positioning slots 154 of the upper base sheet 150 each is disposed at one of four corners defined by the unfolded and folded edges 155 and 152 of the center panel 151, each being associated with a particular one of the four corner cushions 170. The positioning slots 154 as well as the unfolded edges 155 of the upper base sheet 150 are designed to engage with protrusions provided on the bottom sides of the bottom corner cushions 170 for positioning purposes, of which a detailed description will be provided later with reference to FIGS. 11A and 11B and subsequent drawings.

Note that, in the assembled packaging container 100, the enclosure box 120 has the four side walls 123 and 124 resting on the lower base sheet 140 while surrounding the upper base sheet 150 to position the fastening flaps 143 outside the enclosure box 120 and the positioning flaps 153 inside the enclosure box. That is, the interior, upper base sheet 150 has the unfolded and folded edges 155 and 152 located inboard of the adjoining edges of the enclosure box 120, whereas the exterior, lower base sheet 140 has the unfolded and folded edges 145 and 142 located outboard of the adjoining edges of the enclosure box 120 and slightly inboard of the adjoining edges of the pallet 110. In particular, the folded edges 142 of the lower base sheet 140 are spaced away from the pallet edges to allow the tips of the fasteners 160 to remain inboard of the pallet edges, which prevents the fasteners 160 from interfering with surrounding structures, e.g., during handling of the packaging container 100.

In such a configuration, the enclosure base 130 formed of the two base sheets 140 and 150, one outside and the other inside of the enclosure box 120, provides a' durable, sealed structure of the packaging container 100 according to this patent specification.

Specifically, when placed on the enclosure base 130, the bottom edge of the enclosure box 120 establishes a uniform, close contact with the flat center panel 141 of the lower base sheet 140. The uniform contact between the surfaces of the enclosure base 130 and the enclosure box 120 translates into an evenly distributed load on the side walls of the enclosure box 120 where the packaging container 100 is disposed under several other containers during storage and transport, which prevents the side walls, and in particular, the bottom edge of the enclosure box 120, from deformation and breakage under loads, leading to high durability of the packaging container 100 employing the enclosure base 130. Moreover, the closeness of the contacting surfaces effectively seals off the bottom opening 121 of the enclosure box 120, which protects the enclosed article 200 against dust and other contaminants during storage and transport by the packaging container 100.

Further, forming the enclosure base 130 by combining the pair of generally rectangular pieces of cardboard 140 and 150 results in a low-cost and resource-saving manufacture of the packaging container 100. This is because forming rectangular shapes of cardboard for the base sheets 140 and 150 can be accomplished without excessive loss of material, compared to a conventional configuration where cutting complex polygonal shapes out of a sheet of material leaves remains of the material, e.g., where the polygon forms a concave corner, which are generally disposed of as waste during manufacture of the packaging container.

Referring back to FIGS. 5 and 6, in the packaging container 100, the set of fasteners 160 comprises any known fastening devices made of synthetic resin or other suitable material operable from outside the enclosure box 120 without requiring special tools for installation and releasing, each passed from outside into the opening 144 of the fastening flap 143 and then into the through-hole 127 of the side wall 123 to fasten the enclosure base 140 to the enclosure box 120.

The bottom corner cushions 170, each disposed at a bottom corner defined by the walls of the enclosure box 120 and the enclosure base 130, serve to cushion and support four bottom corners of the article 200 mounted on the enclosure base 130 for preventing displacement of the article 200 during transport. The top corner cushions 170, each disposed at a top corner defined by the top and side walls of the enclosure box 120, serve to support four top corners of the article 200 enclosed in the enclosure box 120 for preventing displacement of the article 200 during transport.

The corner cushions 170 and 180 are all formed of plastic foam, such as expanded polystyrene (EPS) or expanded polyethylene (EPE), and are shaped to conform to the shape of the article 200 and to allow for operability during assembly of the packaging container 100.

Figure 9:
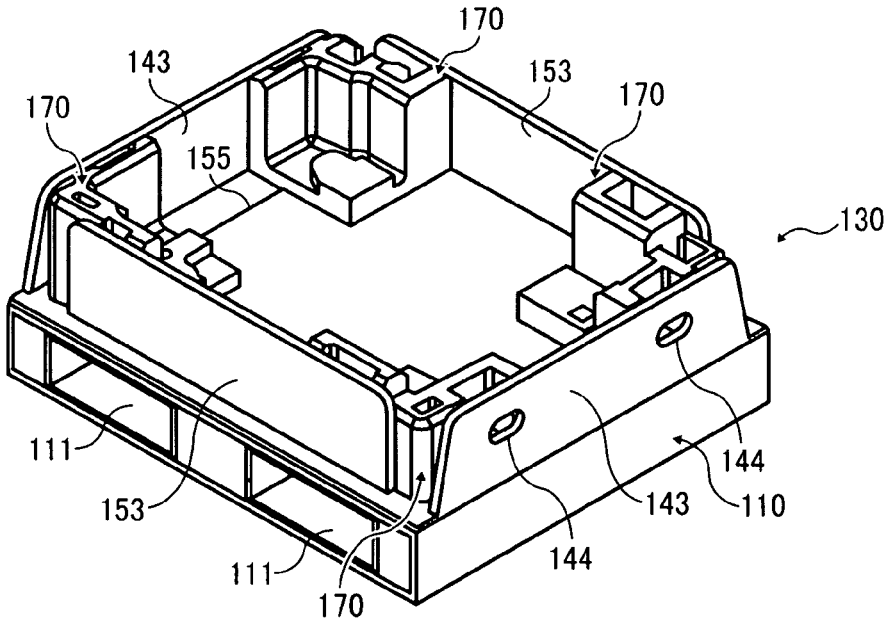
FIG. 9 is a perspective view showing bottom corner cushions disposed in place on the enclosure base during assembly of the packaging container of FIG. 5.
Figure 10:
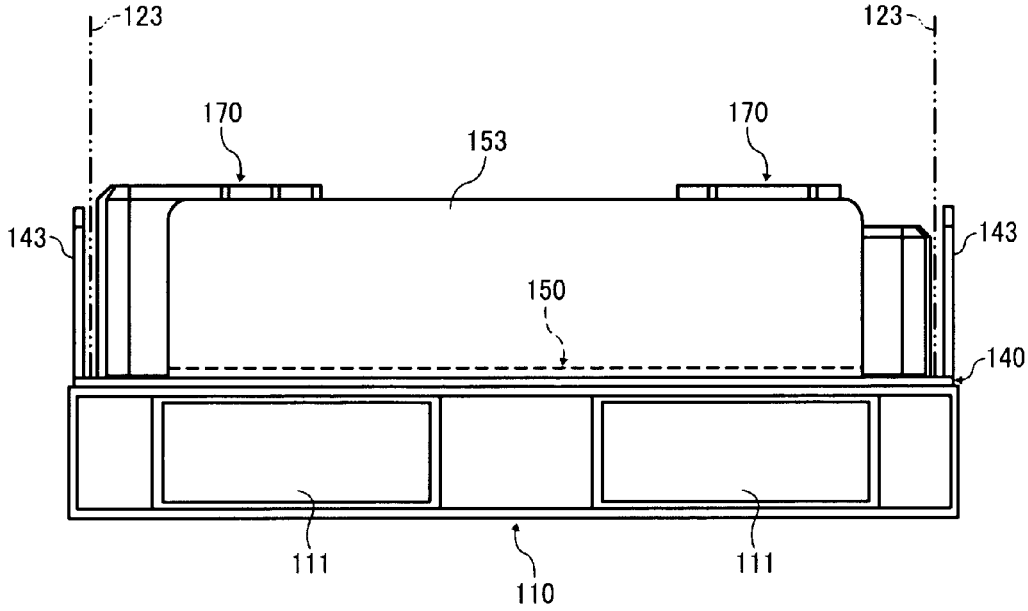
FIG. 10 is a side view of the bottom corner cushions disposed in place on the enclosure base during assembly of the packaging container of FIG. 5.

FIGS. 9 and 10 are perspective and side views, respectively, showing the bottom corner cushions 170 disposed in place on the enclosure base 130 during assembly of the packaging container 100.

As shown in FIG. 9, during assembly, the bottom corner cushions 170 are placed adjacent to the flaps 143 and 153 of the lower and upper base sheets 140 and 150, each fixed in position with respect to the unfolded edge of the upper base sheet 150 as well as to the positioning slot 154 cut in the upper base sheet 150. Once the bottom corner cushions 170 are disposed, the article 200 is mounted with its bottom corners received by the cushions 170, followed by providing the top corner cushions 180, then lowering the enclosure box 120 into place from above so that each first side wall 123 is inserted between the adjoining surfaces of the fastening flap 143 and the bottom corner cushion 170 as shown in FIG. 10.

Figure 11A:
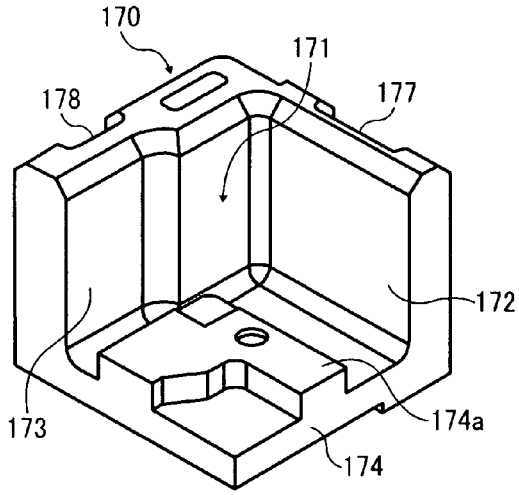
FIGS. 11A and 11B are top and bottom perspective views, respectively, schematically illustrating an example of the bottom corner cushion of FIGS. 9 and 10.
Figure 11B:
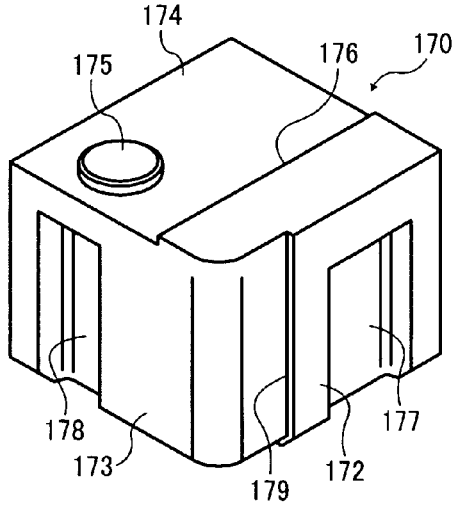

FIGS. 11A and 11B are top and bottom perspective views, respectively, schematically illustrating an example of the bottom corner cushion 170.

As shown in FIGS. 11A and 11B, the bottom corner cushion 170 consists of a bottom wall 174 to face the surfaces of the upper and lower base sheets 150 and 140 of the enclosure base 130; a first side wall 172 to face the bored, first side wall 123 of the enclosure box 120; and a second side wall 173 to face the positioning flap 153 of the enclosure base 130, all extending generally perpendicular to each other to together form a receptacle 171 for receiving a bottom corner of the article 200.

Specifically, the inner surface of the bottom wall 174 is shaped to define a relatively thick, mounting platform **174*a* for mounting the article 200 thereon. Besides the mounting platform 174*a*, the inner surfaces of the bottom wall 174 as well as those of the first and second side walls 172 and 173 are shaped to define several protruding or recessed portions that fit the bottom corner of the article 200** for mounting, positioning, and other operability purposes.

The outer surface of the first side wall 172 is provided with a first recessed portion 177 to accommodate that portion of the fastener 160 inwardly projecting through the side wall 123 of the enclosure box 120. The outer surface of the second side wall 173 is provided with a second recessed portion 178 to prevent the cushion 170 from interfering with adjoining structure. The outer surface of the first side wall 172 may also have another recessed portion 179 for facilitating installation of a reinforcing member, as will be described later in more detail.

The outer surface of the bottom wall 174 has a relatively thick or high, first positioning protrusion 176, and a relatively thin or low, second positioning protrusion 175, the former closer than the latter to the edge where the bottom side wall 174 meet the first side wall 172, for engagement with the unfolded edge 155 and the positioning slot 154, respectively, of the upper base sheet 150.

More specifically, the first positioning protrusion 176 defines a stepped surface to fit generally horizontally along the center panel 151 and downwardly along the unfolded edge 155 when placed on the upper base sheet 150. The second positioning protrusion 175 defines an outwardly convex surface shaped, e.g., in a circular configuration in the present embodiment, to fit in the positioning slot 154 when placed on the upper base sheet 154. Relative positions of the first and second positioning protrusions 176 and 175 are similar to those of the unfolded edge 155 and the positioning slot 154 of the upper base sheet 150.

With additional reference to FIG. 7, the four positioning slots 154 are shown, each with a center thereof spaced away from an adjoining unfolded edge 155 of the upper base sheet 150 by a first distance "D" and from an adjoining folded edge 152 of the upper base sheet 150 by a second distance "d". Each positioning slot 154 is provided with a specific set of distances D and d to determine a configuration of the bottom corner cushion 170 associated therewith, wherein the second positioning protrusion 175 has a center thereof spaced away from the step edge of the first positioning protrusion 176 by a distance similar to the first distance D and away from an outer edge of the bottom wall 174 by a distance similar to the second distance d.

Preferably, the first and second distances D and d are both different for two positioning slots 154 disposed at diagonally opposed corners formed by the unfolded and folded edges of the upper base sheet 150, that is, D1≠D3 and d1≠d3 for the positioning slots 154 disposed on one pair of diagonally opposed corners, and D2≠D4 and d2≠d4 for the positioning slots 154 disposed on the other pair of diagonally opposed corners. Setting the different sets of first and second distances D and d for the diagonally opposite positioning slots 154 prevents mispositioning of the bottom corner cushions 170 during assembly of the packaging container 100.

More preferably, with the conditions D1≠D3, d1≠d3, D2≠D4, and d2≠d4 maintained, at least one of the first and second distances D and d is identical for two positioning slots 154 disposed at adjacent corners of the upper base sheet 150, that is, D1=D2, d1=d4, D3=D4, and d2=d3, so that an imaginary straight line connecting the centers of two positioning slots 154 disposed at adjacent corners of the upper base sheet 150 is parallel to the adjoining edge of the upper base sheet 150.

In other words, given the centers of positioning slots disposed at adjacent corners of the upper base sheet form first through fourth straight imaginary lines therebetween, such imaginary lines are substantially parallel to the adjacent edges of the upper base sheet 150. Further, where the imaginary lines are spaced away from the adjacent edges of the upper base sheet at first through fourth distances "m", "n", "p", and "r", respectively, the distances m, n, p, and r are all different from each other.

Moreover, the distances D1 through D4 and d1 through d4 may be provided in different variations depending on specific configuration of the bottom corner cushions 170. For example, it is also possible that both of the first and second distances D and d are identical for two positioning slots 154 disposed at adjacent corners of the upper base sheet 150, (i.e., D1=D2, d1=d2, D3=D4, and d3=d4), where the shape or visual feature of each cushion 170 provides a clear indication of the corner or positioning slot with which the cushion 170 is associated.

Figure 12A:
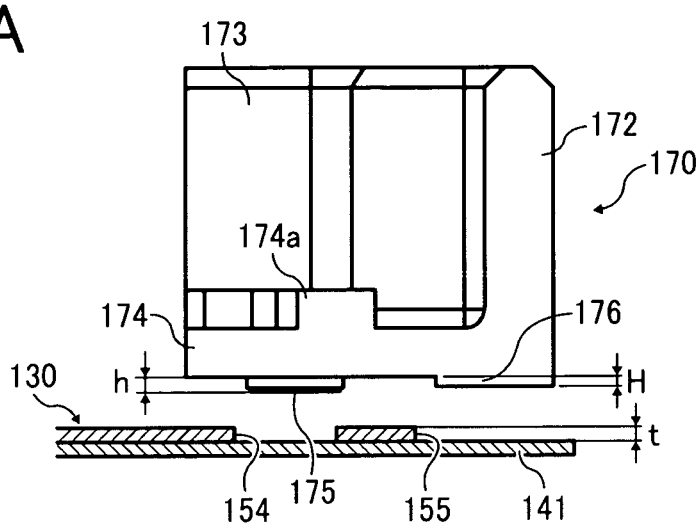
FIGS. 12A through 12C schematically illustrate the bottom corner cushion being mounted onto the enclosure base during assembly of the packaging container of FIG. 5.
Figure 12B:
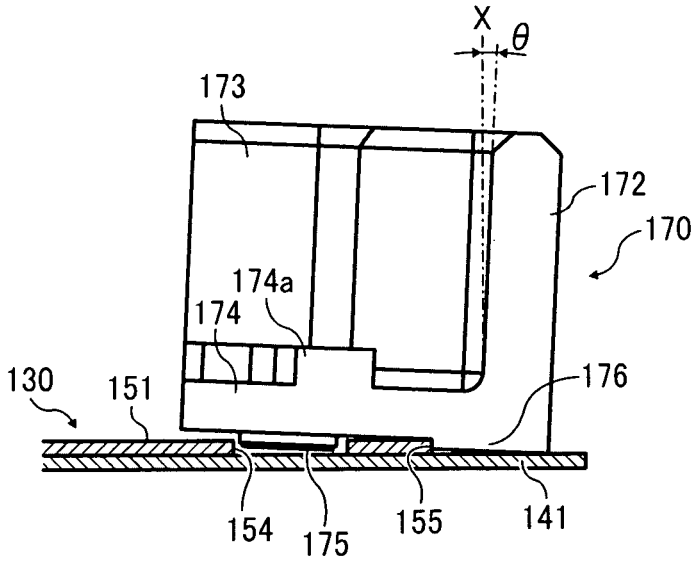
Figure 12C:
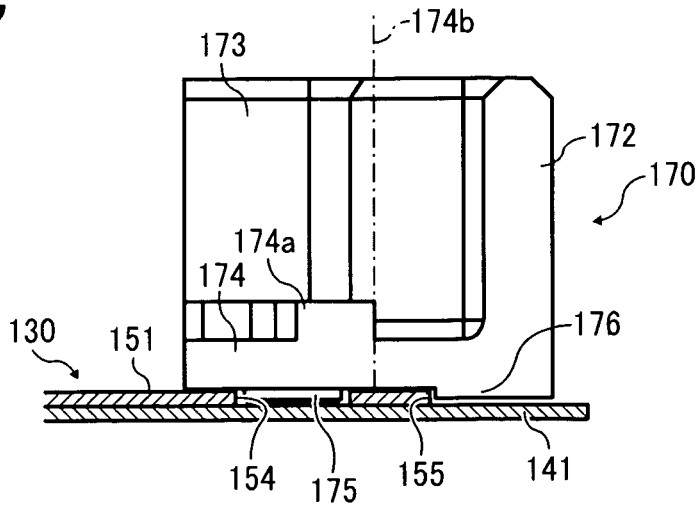

FIGS. 12A through 12C schematically illustrate the bottom corner cushion 170 being mounted onto the enclosure base 130 during assembly of the packaging container 100.

As shown in FIG. 12A, the upper base sheet 150 or the center panel 155 has a thickness t greater than a height H of the first positioning protrusion 176 and equal to or smaller than a thickness h of the second positioning protrusion 175, as given by the following expression:

$$h \geqq t > H$$

Setting the heights H and h of the positioning protrusions 176 and 175 relative to the thickness of the upper base sheet 150 defining the unfolded edge 155 and the positioning slot 154 results in a tilt of the bottom corner cushion 170 upon placement on the upper base sheet 150, as shown in FIG. 12B.

Specifically, when the corner cushion 170 is placed on the enclosure base 130, the positioning protrusions 175 and 176 of different heights form a general slope relative to a horizontal surface of the enclosure base 130, which causes the first side wall 172 to incline outward by an angle θ from an imaginary reference plane X vertical to the horizontal surface. This deliberate inclination of the corner cushion 179 enlarges the space into which the article 200 enters during placement onto the enclosure base 130, which facilitates fitting of the corners of the article 200 to the inner surfaces of the receptacle 171 of the corner cushion 170.

As shown in FIG. 12C, once the article 200 (omitted in the drawing for clarity) is placed on the mounting platform 174*a*, the corner cushion 170 then moves inward from the slightly inclined position. Under weight of the article 200 being mounted, the second positioning protrusion 175 as well as that portion of the center panel 141 underlying the protrusion 175 are compressed until the surface of the bottom wall 174 meets the surface of the center panel 151. Such compression terminates when the corner cushion 170 comes into an upright position substantially vertical to the horizontal surface of the enclosure base 130 so that the article 200 is stabilized in position on the enclosure base 130.

With continued reference to FIG. 12C, a broken line 174*b* designates a plane on which extends an edge of the mounting platform 174*a* closest to the first side wall 172. In the present embodiment, such edge 174*b* of the mounting platform 174*a* is spaced away from where the first positioning protrusion 176 defines a stepped surface, that is, the mounting platform 174*a* and the first positioning protrusion 176 do not overlap each other.

Consider if the mounting platform 174*a* were situated above the first positioning protrusion 176. As mentioned, the first positioning protrusion 176 is thinner than the upper base sheet 150, and hence does not touch the lower base sheet 140 when the corner cushion 170 is in the upright position. Such lack of contact or spacing between the surfaces of the cushion 170 and the enclosure base 130 results in a lower amount of compression of the cushioning material than is possible with a close contact between the adjoining surfaces. Thus, locating the mounting platform 174*a* above the first positioning protrusion 176 would result in a reduced cushioning performance of the bottom corner cushion 170.

By contrast, the mounting platform 174*a* situated inward from the first positioning protrusion 176, i.e., above where the bottom wall 174 establishes a close contact with the underlying surfaces of the enclosure base 130, can be compressed sufficiently upon loading of the article 200 to effectively absorb shock, which ensures good cushioning performance of the bottom corner cushion 170.

Again referring back to FIG. 5, the following describes procedures fox packaging the article 200 using the packaging container 100 according to this patent specification.

First, the enclosure base 130 formed of the lower base sheet 140 and the upper base sheet 150 combined together is placed on the pallet 110 with the bored, fastening flaps 143 on the closed sides of the pallet 110, and the positioning flaps 153 on the open sides of the pallet 110. The center panel 141 of the lower base sheet 140 is bonded to the upper, load-carrying surface of the pallet 110 and the center panel 151 of the upper base sheet 150 is bonded to the upper surface of the lower base sheet 141. After placement of the enclosure base 130, the fastening flaps 143 are folded upward along the fold lines 142, and the positioning flaps 153 are folded upward along the fold lines 153.

Then, the four bottom corner cushions 170 are placed on the respective corners of the enclosure base 130, each with the first positioning protrusion 176 fitted to the corresponding unfolded edge 155 of the upper base sheet 150 and the second positioning protrusion 175 engaged with the corresponding positioning slot 154 of the upper base sheet 150. Each corner cushion 170 is associated with a particular one of the four corners of the base sheet 150, wherein the relative positions of the first and second positioning protrusions 176 and 175 are similar to those of the unfolded edge 155 and the positioning slot 154 at a corner on which the specific cushion 170 is disposed, which ensures that each corner cushion 170 is placed at the intended position on the enclosure base 130.

After positioning the bottom corner cushions 170, the article 200 is mounted with its four bottom corners fitting into the respective receptacles 171 of the cushions 170. Each corner cushion 170 has the positioning protrusions 175 and 176 of different heights to incline outward to the side flap 143 of the enclosure base 130 upon placement onto the enclosure base 130, which facilitates placement of the article 200 without interference with the corner cushions 170. The article 100 thus mounted is further equipped with the top corner cushions 180 placed on the top corners, upon which all the contents of the enclosure are placed on the pallet 110.

Subsequently, the enclosure box 120 is lowered with the open bottom 121 down onto the enclosure base 130, so that the article 200 enters the enclosure box 120 from below through the open bottom 121. The enclosure box 120 thus placed on the enclosure base 130 has the first pair of side walls 123 located inboard of the fastening flaps 143, and the second pair of side walls 124 outboard of the positioning flaps 153, so that the four side walls 123 and 124 of the enclosure box 120 rest on the lower base sheet 140 while entirely surrounding the upper base sheet 150.

As mentioned, when placed on the enclosure base 130, the bottom edge of the enclosure box 120 establishes a uniform, close contact with the flat center panel 141 of the lower base sheet 140. The uniform contact between the surfaces of the enclosure base 130 and the enclosure box 120 translates into an evenly distributed load on the side walls of the enclosure box 120, which prevents damage to the enclosure box 120, leading to high durability of the packaging container 100 employing the enclosure base 130. Moreover, the closeness of the contacting surfaces provides an effective seal that protects the enclosed article 200 against dust and other contaminants during storage and transport by the packaging container 100.

After placing the enclosure box 120 on the enclosure base 130, the fasteners 160 are inserted into the openings 144 and the through-holes 127 aligned together, so as to hold together the adjoining walls of the enclosure box 120 and the enclosure base 130. The fastener 160 can be operated from outside without interfering with the bottom corner cushion 170 disposed close to the through-hole 127 within the enclosure box 120, owing to the recessed portion 177 provided on the side wall 172 of the cushion 170 which creates a space for accommodating protrusions of the fastener 160 being installed.

Upon installation of the fasteners 160, assembly of the packaging container 100 is completed, wherein the article 200 is mounted on the pallet 110 which is connected to the enclosure box 120 through the closure base 130. The article 200, thus packaged without direct connection with the pallet 110 and the enclosure box 120, is securely held in position on the load-carrying surface of the pallet 110, wherein the positioning flaps 153 provided on both sides of the article 200 effectively transmit load to the underlying pallet 110 during transport, and the bottom corner cushions 170 supporting the bottom corners of the article 200 connect the article 200 to the surfaces of the upper base sheet 150 and the enclosure box 120.

The completed container 100 is ready for handling by a forklift, which can insert its tines into the entries 111 on the open sides of the pallet 110. When required, the container 100 allows access to the enclosed article 200, in which case the fasteners 160 are disengaged and removed from the through-holes 127 an 144, followed by lifting the enclosure box 120 away from the pallet 110 carrying the article 200.

Figure 13:
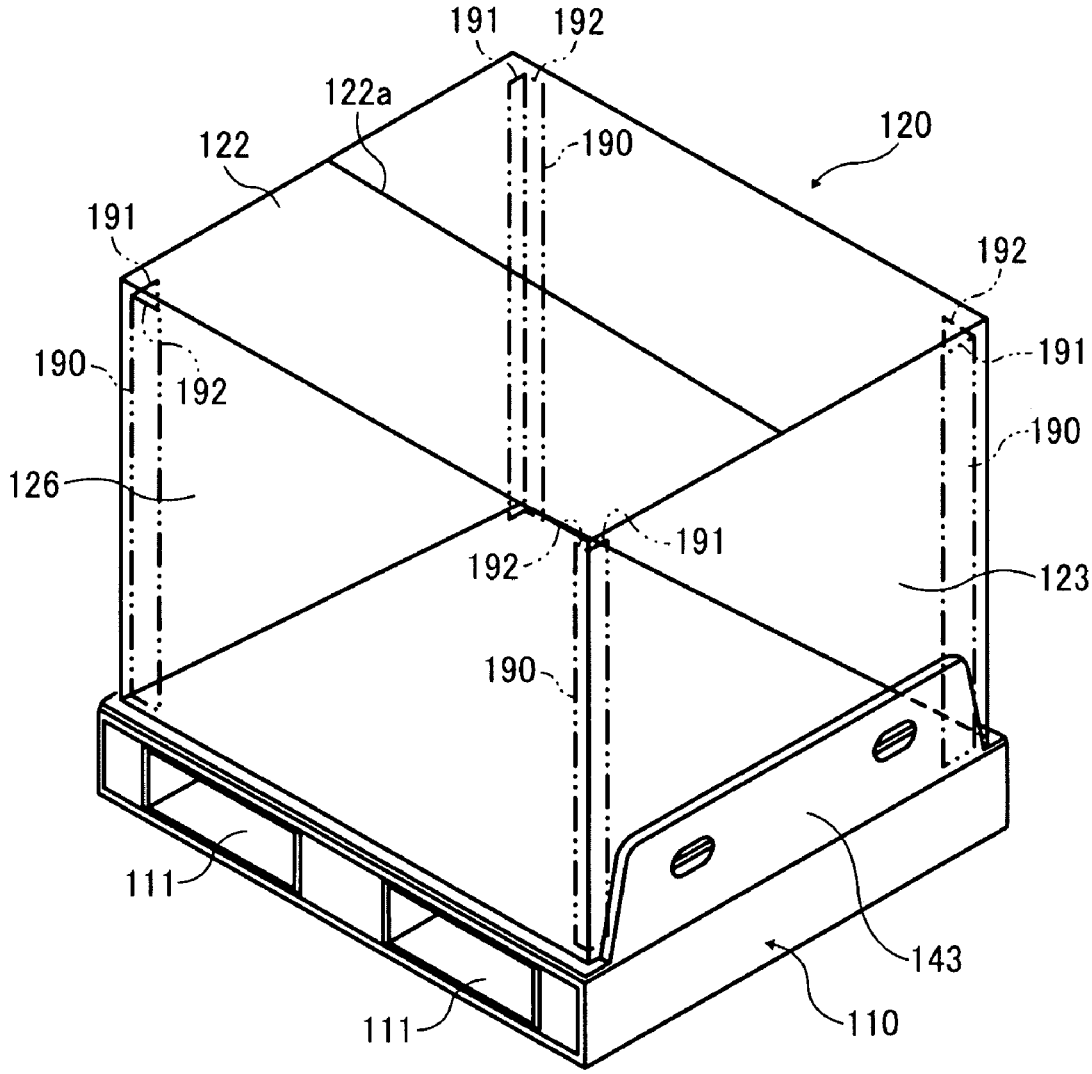
FIG. 13 is a perspective view schematically illustrating the packaging container of FIG. 5 equipped with a set of reinforcing members.

In a further embodiment, the packaging container 100 according to this patent specification may have a set of reinforcing members 190 disposed within the enclosure box 120 to brace a height of the enclosure box 120 extending between the top wall 122 of the enclosure box and the surface of the enclosure base 130. FIG. 13 is a perspective view schematically illustrating the packaging container 100 equipped with such reinforcing members 190.

As shown in FIG. 13, the reinforcing member 190 may comprise an elongated piece of stiff paper consisting of a pair of first and second panels 191 and 192, each having a length substantially equal to that of the side walls of the enclosure box 120 and oriented substantially perpendicular to each other to define a generally L-shaped cross-section.

In use, the four reinforcing member 190 are inserted into the enclosure box 120 with the bottom corner cushions 170 in position and the top corner cushions 180 removed or not yet installed, each having the first panel 191 slipped along the first side wall 123 and the second panel 192 along the second side wall 124 of the enclosure box 120. The insertion into the enclosure box 120 may be performed, for example, from above through a top opening 122*a* defined by a pair of meeting edges extending along the length or width of the top wall 122. After all the reinforcing members 190 are installed, the top corner cushions 180 are disposed between the article 200 and the walls of the enclosure box 120, followed by closing the top wall 122 to complete the assembly.

In the assembled container 100, each reinforcing member 190 has its lower edge contacting the flat panel 141 of the lower base sheet 140 and its upper edge contacting the top wall 122 of the enclosure box 120. The reinforcing members 190 thus connecting the top and bottom of the enclosure can effectively transmit pressure applied to the top wall 122 downward to the upper base sheet 140 and eventually to the pallet 110 supporting the enclosure box 120. Such reinforcement prevents the side walls 123 and 124 from deforming outward under imposed loads, particularly in the presence of moisture that can soften and structurally weaken the cardboard enclosure box 120.

Figure 14A:
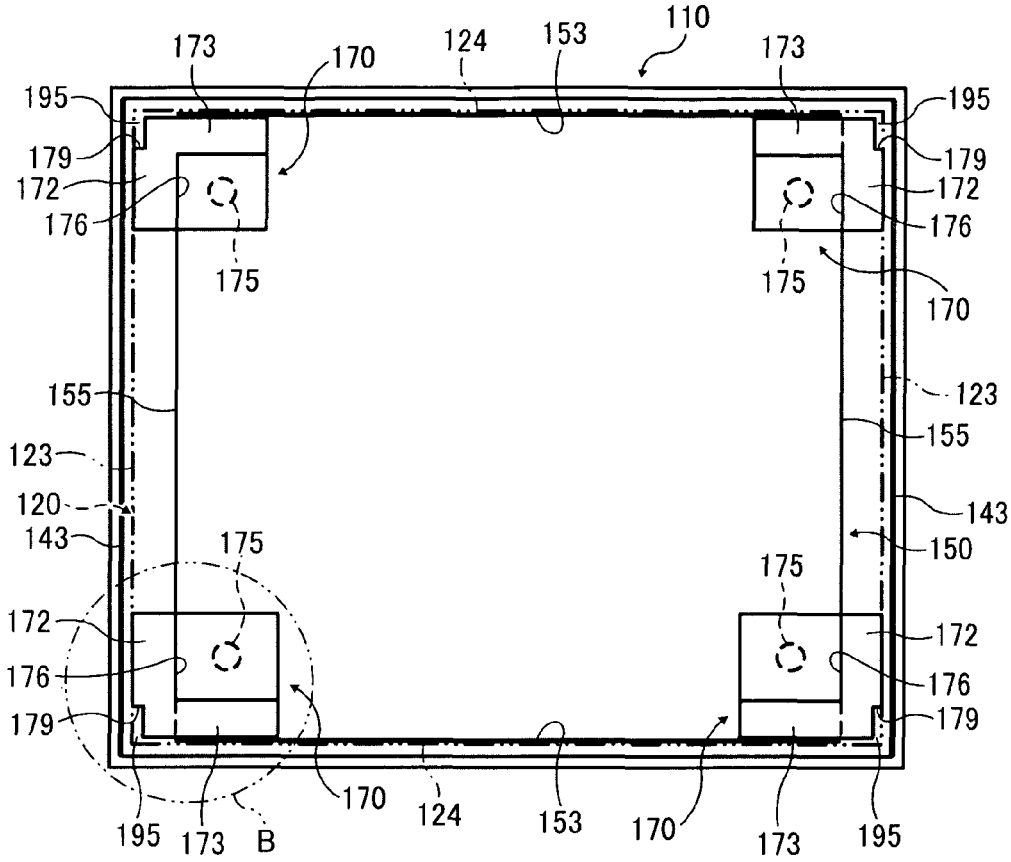
FIG. 14A is a plan view schematically illustrating a configuration of the packaging container for use with the reinforcing members of FIG. 13.
Figure 14B:
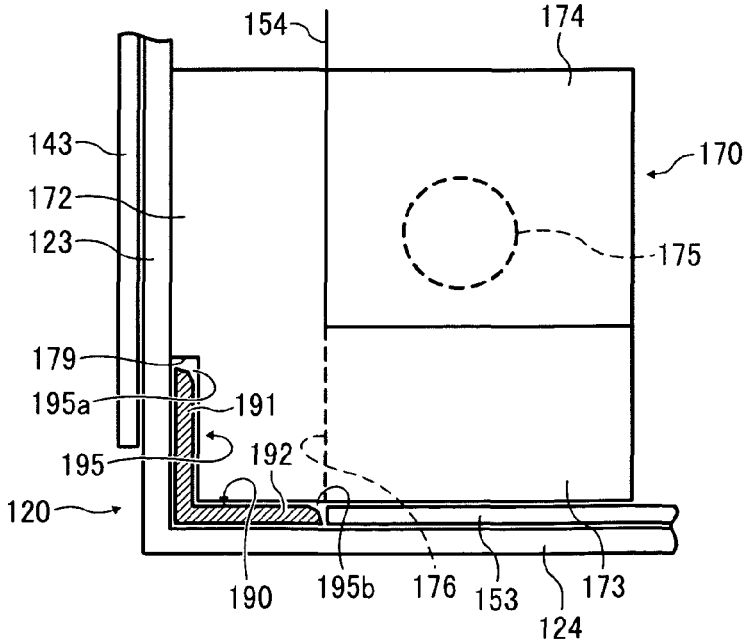
FIG. 14B is an enlarged view of a corner of the packaging container, encircled by a broken line in FIG. 14A.

FIG. 14A is a plan view schematically illustrating a configuration of the packaging container 100 for use with the reinforcing members 190 of FIG. 13, and FIG. 14B is an enlarged view of a corner of the packaging container 100, encircled by a broken line in FIG. 14A.

As shown in FIGS. 14A and 14B, the first side wall 172 of each bottom corner cushion 170 has a recessed portion 179 extending vertically along the corner edge of the cushion 170, which creates a clearance or space 195*a* between the side wall 123 of the enclosure box 120 and the side wall 172 of the corner cushion 170 when the corner cushion 170 is in position. On the other hand, the second side wall 173 of each bottom corner cushion 170, which is generally planar in the present embodiment, is spaced away from the side wall 124 of the enclosure box 120 by the thickness of the positioning flap 153 against which the second side wall 173 of the bottom corner cushion 170 rests flush, so as to create a clearance or space 195*b* between the side wall 124 of the enclosure box 120 and the side wall 173 of the corner cushion 170 when the corner cushion 170 is in position.

The spaces 195*a* and 195*b* merge at the corner of the enclosure to together form a guide slot 195 with a generally L-shaped cross-section slightly larger than that of the reinforcing member 190, which guides and accommodates the lower end of the reinforcing member 190 for preventing interference with the adjacent surfaces of the bottom corner cushion 170 and the positioning flap 153 at the corner of the enclosure box 120. Provision of the guide slots 195 thus facilitates installation of the reinforcing members 190, leading to increased operability of the packaging container 100.

Although the embodiment described above with reference to FIG. 13 and FIGS. 14A and 14B depicts the reinforcing members 190 as an elongated piece with a generally L-shaped cross-section, the reinforcing members 190 may be formed in any suitable configuration, with appropriate modification of the corresponding guide slots 195.

In a still further embodiment, the packaging container 100 according to this patent specification may use a bottom corner cushion 270 with multiple second positioning protrusions 275 on the bottom side, as depicted below with reference to FIGS. 15A and 15B.

Figure 15A:
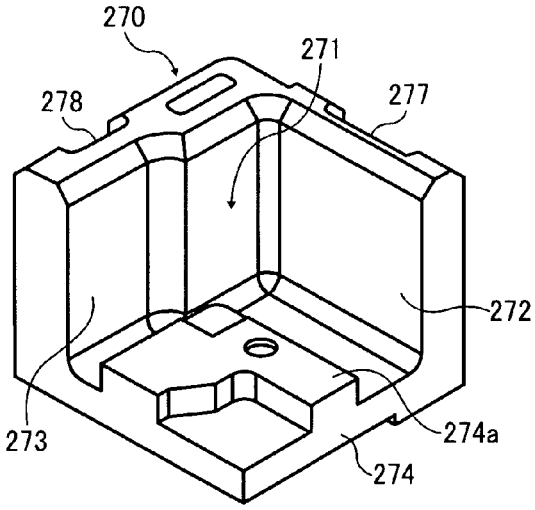
FIGS. 15A and 15B are top and bottom perspective views, respectively, schematically illustrating another example of the bottom corner cushion of FIGS. 9 and 10.
Figure 15B:
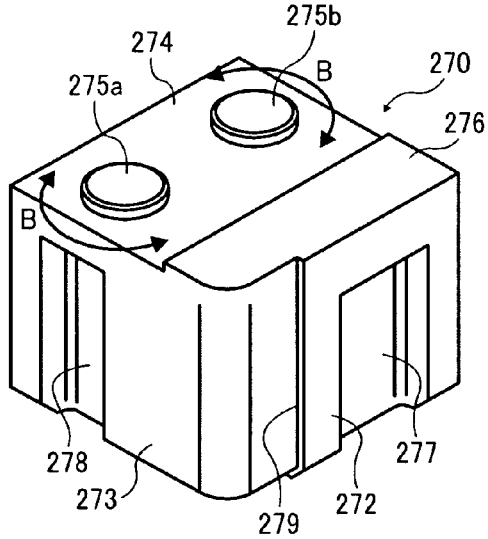

As shown in FIGS. 15A and 15B, the bottom corner cushion 270 is similar to that depicted with reference to FIGS. 9A and 9B, having a bottom wall 274, a first side wall 272, and a second side wall 273, all extending generally perpendicular to each other to together form a receptacle 271 for receiving a corner of the article 200, except that the bottom wall 274 has a pair of second positioning protrusions 275*a* and 275*b*, instead of the single positioning protrusion 175, arranged along a first positioning protrusion 276.

Specifically, the positioning protrusions 275*a* and 275*b* have a configuration and function similar to that depicted with reference to FIGS. 11A and 11B and FIGS. 12A through 12C. The positioning protrusions 275*a* and 275*b*, one of which may be disposed where the single positioning protrusion 175 is in the foregoing embodiment, are arranged, for example, in line with the inner edge of the first positioning protrusion 276, so as to uniformly distribute loads therebetween upon mounting of the article 200 on the bottom corner cushion 270 (i.e., in the state shown in FIG. 12C).

Figure 16:
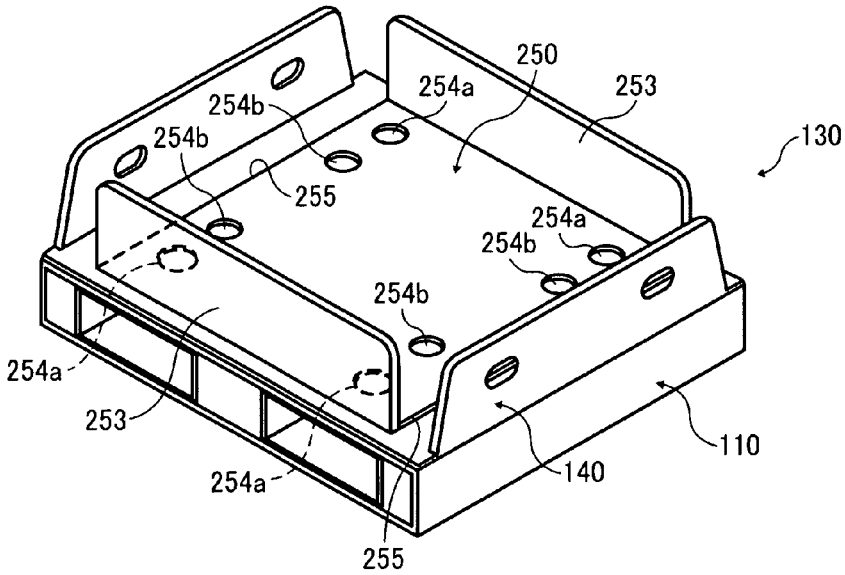
FIG. 16 is a perspective view schematically illustrating the enclosure base upon installation, arranged for use with the bottom corner cushions of FIGS. 15A and 15B.

FIG. 16 is a perspective view schematically illustrating the enclosure base 130 with an upper base sheet 250 arranged for use with the bottom corner cushions 270 of FIGS. 15A and 15B.

As shown in FIG. 16, in the present embodiment, the upper base sheet 250 is provided with four pairs of positioning slots 254*a* and 254*b* each disposed along a unfolded edge 255 of a flat center panel 251 for engagement with the paired positioning protrusions 275*a* and 275*b*.

Provision of the paired positioning protrusions 275*a* and 275*b* and the corresponding positioning slots 254*a* and 254*b* prevents the bottom corner cushion 270 from horizontal displacement or pivoting around the positioning protrusion as indicated by arrows B in FIG. 15B, which can occur due to a clearance provided between the adjoining edges of the first positioning edge and the unfolded edge of the upper base sheet for ease of assembly. Such protection against displacement of the bottom corner cushions 270 ensures stability of the article 200 cushioned by the corner cushions 270 in the packaging container 100.

To recapitulate, the packaging container 100 according to this patent specification includes a pallet 110 disposed at a bottom of the container 100; an enclosure base 130 placed on the pallet to support the article 200 thereon; an enclosure box 120 placed on the enclosure base 130 to enclose the article 200 therewithin; and a set of fasteners 170.

The enclosure base 130 includes a generally rectangular, lower base sheet 140 overlying and attached to the pallet 110, which has a pair of opposed parallel edges 145 unfolded and another pair of opposed parallel edges 142 folded to form a first pair of side flaps 143 extending substantially upward therefrom; and a generally rectangular, upper base sheet 150 overlying and attached to the lower base sheet 140, which has a pair of opposed parallel edges 155 unfolded and another pair of opposed parallel edges 152 folded to form a second pair of side flaps 153 extending substantially upward therefrom.

The enclosure box 120 includes a top wall 122 to cover the article 200 from above; a set of four side walls 123 and 124 extending from the top wall 122 to surround the article 200 from all sides; and an open bottom 121 defined by edges of the four side walls 123 and 124 opposite to the top wall 122 to allow entry of the article 200 during installation. The four side walls of the enclosure box 120 rest on the lower base sheet 140 while surrounding the upper base sheet 150 to position the first pair of opposed side flaps 143 outside the enclosure box 120, and the second pair of opposed side flaps 153 inside the enclosure box 120.

Each fastener 160 is passed from outside through one of the first pair of opposed side flaps 143 and then through one of the side walls 123 of the enclosure box 120 to fasten the enclosure base 130 to the enclosure box 120.

In such a configuration, the packaging container 100 provides a highly durable, sealed enclosure that can be produced with reduced resource waste and manufacturing cost, wherein the enclosure base 130 formed of the pair of substantially rectangular, lower and upper base sheets 140 and 150 combined together establishes a uniform, close contact with the bottom edge of the enclosure box 120 to prevent damage to the enclosure box under imposed loads.

Moreover, the packaging container 100 may be provided with a set of cushions 170 placed on the enclosure base 130 to cushion and support the article 200 within the enclosure box 120. Each cushion 170 is fixed in position with respect to the unfolded edge 155 of the upper base sheet 150 as well as to a positioning slot 154 cut in the upper base sheet, which allows for secure and reliable positioning of the cushion 170, leading to enhanced stability and operability of the packaging container 100.

In addition, the packaging container 100 may be further provided with a reinforcing member 190 to brace a height of the enclosure box 120 extending between the top wall 122 of the enclosure box and a surface of the enclosure base 130. Such a reinforcement member 190 is ready to install in the packaging container 100, wherein the top wall 123 of the enclosure box 120 is openable to allow insertion of the reinforcing member from above into the enclosure box during assembly, and the cushion 170 has a recessed portion 179 at a side thereof to create a space 195 between the cushion 170 and the side walls of the enclosure box 120 along which the reinforcing member 190 is guided during insertion into the enclosure box 120.

Numerous additional modifications and variations are possible in light of the above teachings. For example, the pallet used in the packaging container according to this patent specification may be made of synthetic resin, metal, or any suitable material and may have four open sides to allow entry of forklift tines from four directions depending on the intended application, although the embodiments described herein use a two-way pallet of wood or plywood.

Further, although the enclosure box, the enclosure base, and the sheet described above are formed of corrugated cardboard, alternatively these components may be formed of corrugated plastic or any other suitable material, and may be suitably sized and shaped depending on the intended application.

Furthermore, although the bottom corner cushion described in the above embodiments is provided with first and second positioning protrusions forming stepped and outwardly convex surfaces, respectively, for positioning with respect to the enclosure base, such positioning may be performed using any structure that can hold the corner cushion in position on the enclosure base.

It is therefore to be understood that, within the scope of the appended claims, the disclosure of this patent specification may be practiced otherwise than as specifically described herein.

What is claimed is:

1. A container used to package an article, the container comprising:

a pallet disposed at a bottom of the container;

an enclosure base placed on the pallet to support the article thereon, the enclosure base including:

a lower base sheet overlying and attached to the pallet, the lower base sheet having a first pair and a second pair of opposed edges, both the first and second pair of edges on a plane with the lower base sheet, the lower base sheet terminating at the first pair of opposed edges and extending substantially vertically from the second pair of opposed edges to form a first pair of side flaps; and an upper base sheet overlying and attached to the lower base sheet, the upper base sheet having a first pair of opposed edges and a second pair of opposed edges, both the first pair and second pair of edges on a plane with the upper base sheet, the upper base sheet terminating at the first pair of opposed edges and extending substantially vertically from the second pair of opposed edges to form a second pair of side flaps, the first pair of opposed edges of the upper base sheet being parallel to the first pair of side flaps and the first pair of opposed edges of the lower base sheet being parallel to the second pair of side flaps;

an enclosure box placed on the enclosure base to enclose the article therewithin, the enclosure box including:

a top wall to cover the article from above;

a set of four side walls extending from the top wall to surround the article from all sides; and an open bottom defined by edges of the four side walls opposite to the top wall to allow entry of the article during installation;

the four side walls of the enclosure box resting on the lower base sheet while surrounding the upper base sheet to position the first pair of opposed side flaps outside the enclosure box, and the second pair of opposed side flaps inside the enclosure box; and a set of fasteners each passed from outside through one of the first pair of opposed side flaps and then through one of the side walls of the enclosure box to fasten the enclosure base to the enclosure box.

2. The container according to claim 1, further comprising a cushion placed on the enclosure base to cushion and support the article within the enclosure box, the cushion being fixed in position with respect to the first edge of the upper base sheet as well as to a positioning slot cut in the upper base sheet.

3. The container according to claim 2, wherein the cushion has a pair of first and second positioning protrusions at a bottom side thereof for engagement with the first edge and the positioning slot, respectively, of the upper base sheet, the first positioning protrusion defining a stepped surface to fit substantially horizontally along a surface of the upper base sheet and downwardly along the first edge of the upper base sheet when placed on the upper base sheet, the second positioning protrusion defining an outwardly convex surface to fit in the positioning slot of the upper base sheet when placed on the upper base sheet.

4. The container according to claim 3, wherein the cushion has multiple second positioning protrusions for engagement with multiple positioning slots provided along the first edge of the upper base sheet.

5. The container according to claim 3, wherein the upper base sheet has a thickness greater than a height of the first positioning protrusion and equal to or smaller than a thickness of the second positioning protrusion.

6. The container according to claim 5, wherein the cushion has a mounting platform defined at an upper side thereof for mounting a bottom of the article thereon, the mounting platform not overlapping the first positioning protrusion defined at the bottom side of the cushion.

7. The container according to claim 2, wherein the upper base sheet has a set of four positioning slots defined adjacent to four corners formed by the first pair of opposed edges and the second pair of opposed edges, each positioning slot having a center spaced away from an adjoining first edge by a first distance and from an adjoining second edge by a second distance, both the first and second distances being different for two positioning slots disposed at diagonally opposed corners of the upper base sheet.

8. The container according to claim 7, wherein at least one of the first and second distances is identical for two positioning slots disposed at adjacent corners of the upper base sheet.

9. The container according to claim 7, wherein the centers of first and second positioning slots disposed at adjacent corners of the upper base sheet form a first straight imaginary line therebetween substantially parallel to, and spaced from an adjacent edge of the upper base sheet at a distance "m", the centers of second and third positioning slots disposed at adjacent corners of the upper base sheet form a second straight imaginary line therebetween substantially parallel to, and spaced from an adjacent edge of the upper base sheet at a distance "n", the centers of third and fourth positioning slots disposed at adjacent corners of the upper base sheet form a third straight imaginary line therebetween substantially parallel to, and spaced from an adjacent edge of the upper base sheet at a distance "p", and the centers of fourth and first positioning slots disposed at adjacent corners of the upper base sheet form a fourth straight imaginary line therebetween substantially parallel to, and spaced from an adjacent edge of the upper base sheet at a distance "r", the distances m, n, p, and r being all different from each other.

10. The container according to claim 1, further comprising a reinforcing member to brace a height of the enclosure box extending between the top wall of the enclosure box and a surface of the enclosure base, wherein the top wall of the enclosure box is openable to allow insertion of the reinforcing member from above into the enclosure box during assembly, and a cushion has a recessed portion at a side thereof to create a space between the cushion and the side wall of the enclosure box along which the reinforcing member is guided during insertion into the enclosure box.

11. The container according to claim 1, wherein the enclosure box is in direct contact with the first pair of opposed side flaps.

12. A container used to package an article, the container comprising:

an enclosure base, the enclosure base including:

a lower base sheet having a first pair and a second pair of opposed edges, both the first and second pair of edges on a plane with the lower base sheet, the lower base sheet terminating at the first pair of opposed edges and extending substantially vertically from the second pair of opposed edges to form a first pair of side flaps; and an upper base sheet overlying and attached to the lower base sheet, the upper base sheet having a first pair of opposed edges and a second pair of opposed edges, both the first pair and second pair of edges on a plane with the upper base sheet, the upper base sheet terminating at the first pair of opposed edges and extending substantially vertically from the second pair of opposed edges to form a second pair of side flaps, the first pair of opposed edges of the upper base sheet being parallel to the first pair of side flaps and the first pair of opposed edges of the lower base sheet being parallel to the second pair of side flaps;

an enclosure box placed on the enclosure base to enclose the article therewithin, the enclosure box including a top and four side walls resting on the lower base sheet while surrounding the upper base sheet to position the first pair of opposed side flaps outside the enclosure box and the second pair of opposed side flaps inside the enclosure box; and fasteners, each passed from outside through one of the first pair of opposed side flaps and then through one of the side walls of the enclosure box to fasten the enclosure base to the enclosure box.

13. The container according to claim 12, further comprising a cushion placed on the enclosure base to cushion and support the article within the enclosure box, the cushion being fixed in position with respect to the first edge of the upper base sheet as well as to a positioning slot cut in the upper base sheet.

14. The container according to claim 13, wherein the cushion has a pair of first and second positioning protrusions at a bottom side thereof for engagement with the first edge and the positioning slot, respectively, of the upper base sheet, the first positioning protrusion defining a stepped surface to fit substantially horizontally along a surface of the upper base sheet and downwardly along the first edge of the upper base sheet when placed on the upper base sheet, the second positioning protrusion defining an outwardly convex surface to fit in the positioning slot of the upper base sheet when placed on the upper base sheet.

15. The container according to claim 14, wherein the cushion has multiple second positioning protrusions for engagement with multiple positioning slots provided along the first edge of the upper base sheet.

16. The container according to claim 13, wherein the upper base sheet has four positioning slots defined adjacent to four corners formed by the first pair of opposed edges and the second pair of opposed edges, each positioning slot having a center spaced away from an adjoining edge first edge by a first distance and from an adjoining second edge by a second distance, both the first and second distances being different for two positioning slots disposed at diagonally opposed corners of the upper base sheet.

17. The container according to claim 12, further comprising a reinforcing member to brace a height of the enclosure box extending between the top wall of the enclosure box and a surface of the enclosure base, wherein the top of the enclosure box is openable to allow insertion of the reinforcing member from above into the enclosure box during assembly, and a cushion has a recessed portion at a side thereof to create a space between the cushion and the side wall of the enclosure box along which the reinforcing member is guided during insertion into the enclosure box.

18. The container according to claim 12, wherein the enclosure box is in direct contact with the first pair of opposed side flaps.

19. A container used to package an article, the container comprising:

an enclosure base, the enclosure base including:

a lower base sheet including two opposed sidewalls normal to a plane of the lower base sheet, the sidewalls extending substantially vertically and forming a first pair of side flaps;

an upper base sheet including two opposed sidewalls normal to a plane of the upper base sheet, the sidewalls extending substantially vertically and forming a second pair of side flaps, the second pair of side flaps orientated perpendicularly to the first pair of side flaps;

an enclosure box placed on the enclosure base to enclose the article therewithin, the enclosure box including a top and four side walls resting on the lower base sheet while surrounding the upper base sheet to position the first pair of opposed side flaps outside the enclosure box and the second pair of opposed side flaps inside the enclosure box; and fasteners, each passed from outside through one of the first pair of opposed side flaps and then through one of the side walls of the enclosure box to fasten the enclosure base to the enclosure box.

20. The container according to claim 19, wherein the enclosure box is in direct contact with the first pair of opposed side flaps.

* * * * *